United States Patent [19]

Kussoy

[11] 4,248,071

[45] Feb. 3, 1981

[54] SEPARABLE HOLDER

[76] Inventor: Mel Kussoy, 104-20 Queens Blvd., Forest Hills, N.Y. 11375

[21] Appl. No.: 31,864

[22] Filed: Apr. 20, 1979

[51] Int. Cl.[3] ..... A47G 29/10

[52] U.S. Cl. ..... 70/456 R; 70/459

[58] Field of Search ..... 70/456 R, 456 B, 457, 70/458, 459; 403/405, 365, 370, 343, 306, 308, 184, 48; 24/208 R, 208 A; 85/42

[56] References Cited

U.S. PATENT DOCUMENTS

| | | | |
|---|---|---|---|
| 2,975,497 | 3/1961 | Budrock | 70/459 |
| 3,881,334 | 5/1975 | Wilson | 70/457 |
| 3,906,763 | 9/1975 | Bochory | 70/456 R |
| 4,091,646 | 5/1978 | Sugimoto | 70/459 |

*Primary Examiner*—Robert L. Wolfe

*Attorney, Agent, or Firm*—Toren, McGeady and Stanger

[57] ABSTRACT

A separable holder, such as for holding keys or the like, includes a plastic central portion having a body portion and first and second threaded projections extending from opposite ends of the body portion. First and second end portions, each having an internally threaded longitudinal opening, are also included. The first and second threaded projections removably screw into the internally threaded openings of the first and second end portions. The end portions have transverse holes through which first and second split ring elements are inserted. The split ring elements may hold keys, for example. A second embodiment has a central portion which itself is composed of first and second sub-portions which screw into one another. In a preferred construction, the central portion is transparent plastic while the end portions are metal.

7 Claims, 6 Drawing Figures

SEPARABLE HOLDER

FIELD OF THE INVENTION

The present invention relates to separable holders and, more particularly, separable holders primarily used for holding keys.

BACKGROUND OF THE INVENTION

Recently, holders for keys and the like have been commercially available which allow separation of keys onto rings. The two rings can be separated by a suitable mechanical arrangement which allows the rings to be pulled apart. This will permit the ignition key of a car to be readily separated from the driver's trunk and house keys when entering a parking lot, for example. The type of mechanical arrangement commonly used for such pull-apart holders is of the metallic insert type. Such arrangements are purely functional and have no inherently aesthetic appeal. Such arrangements also feature spring catches which, with time, may fatique.

OBJECTS OF THE INVENTION

It is an object of the present invention to provide a separate holder which is simple and mechanically reliable which, at the same time, is aesthetically attractive. It is also an object of the present invention to provide a separable holder which utilizes both metal and machine plastic portions.

SUMMARY OF THE INVENTION

In accordance with the invention, a separable holder comprises a plastic central portion having a body portion and having first and second threaded projections extending from opposite ends of the body portion. The body portion also has annular shoulders at opposite ends thereof. First and second end portions are included, each having an internally threaded longitudinal opening and an annular end wall surrounding the opening. The first and second threaded projections are for being removably screwed into corresponding internally threaded openings of the first and second end portions. The annular shoulders of the body abut corresponding annular walls of the first and second end portions. Each of the first and second end portions have transverse holes therethrough. Finally included are first and second split ring elements inserted in the corresponding transverse holes of the first and second end portions. The ring elements are for having hole-bearing elements inserted thereon.

For a better understanding of the present invention, reference is made to the following description and accompanying drawings, while the scope of the present invention will be pointed out in the appended claims.

DESCRIPTION OF THE PREFERRED EMBODIMENTS

Figure 1:
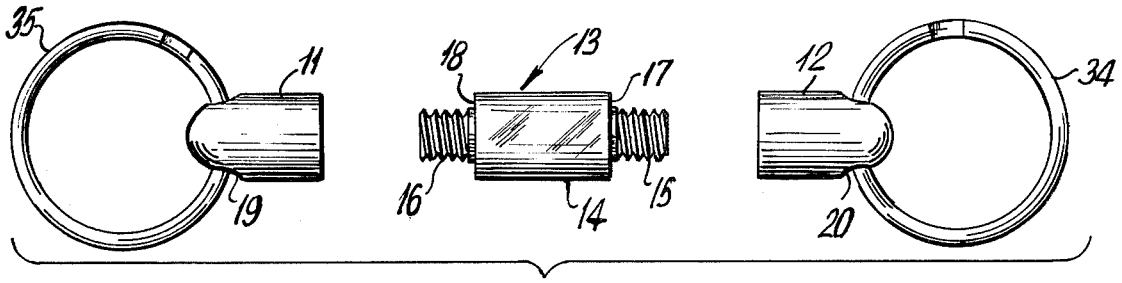
FIG. 1 illustrates in pictorial representation the separable holder of the present invention in its disassembled state.
Figure 3:
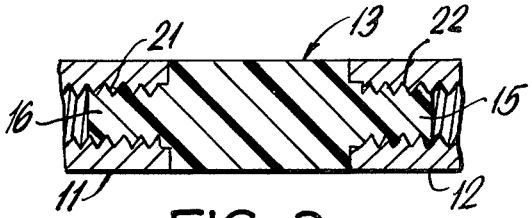
FIG. 3 is a partial sectional view taken along section 3,3 of FIG. 2.

Referring initially to FIGS. 1 and 3, shown there is a separable holder in accordance with the present invention. The separable holder 10 comprises three major parts, the plastic central portion 13 and the two end portions 11 and 12, which are preferably of metal.

The plastic central portion includes a body 14 which is typically a transparent tubular plastic element. Attached to the body and forming an integral part thereof are threaded projections 15 and 16. These projections are also of plastic and are suitably machined from a stock of plastic which is common with body 14.

Surrounding the threaded projections are annular shoulders of the body 17 and 18. As will be described below, these shoulders provide an essential aspect of the overall construction of the holder which results in its durability and also prevents the more delicate projections 15 and 16 from otherwise being snapped off the central portion.

Figure 2:
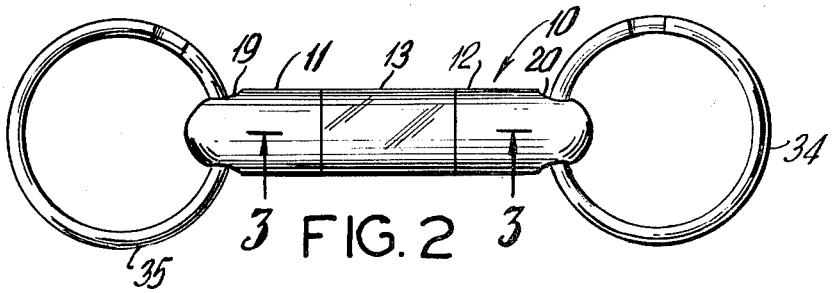
FIG. 2 illustrates in pictorial representation the separable holder of the present invention in assembled state.

The end portions 11 and 12 have internally threaded longitudinal openings 21 and 22 which cooperate with the projections 15 and 16. FIGS. 2 and 3 show the assembled holder, FIG. 3 indicating in cross-section the way the central portion is screwed into the internally threaded portions of the end portions 11 and 12.

The end portions have annular shoulders which abut annular shoulders 18 and 17 of the central portion. Thus, as can be seen in FIG. 3 in side view, these shoulders provide an interlocking fit which prevents any torsional or shear forces from breaking off the plastic projection elements 15 and 16.

In the end portions 11 and 12 are disposed through-holes 19 and 20 which are transverse to the longitudinal axis of the holder when assembled. In these through-holes are disposed split ring elements 34 and 35. These split ring elements are intended to hold keys or similar hole-bearing elements. Each key has a hole therein which is slid along a split ring until the key fully engages the ring itself.

Figure 4:
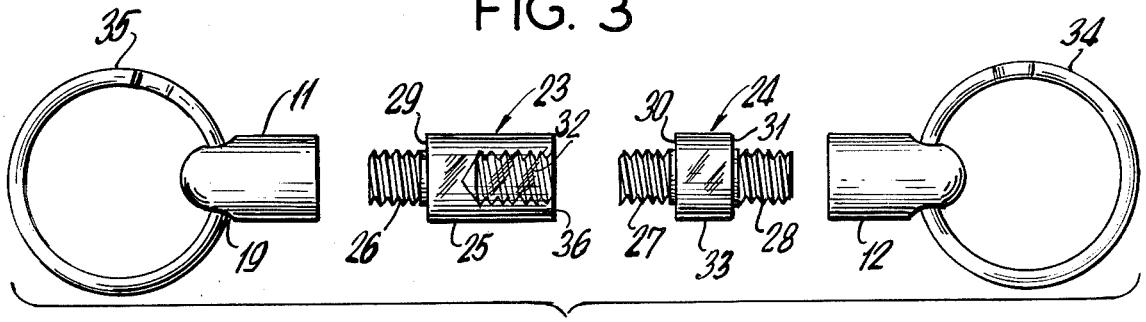
FIG. 4 is a pictorial representation of another embodiment of the separable holder of the present invention in its disassembled state.
Figure 5:
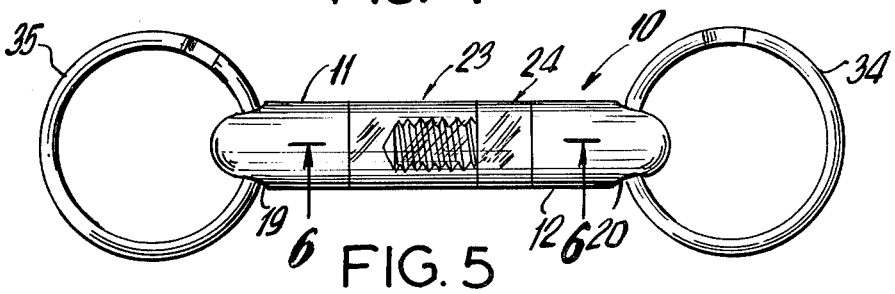
FIG. 5 is the separable holder shown in FIG. 4 in its assembled state in pictorial representation.
Figure 6:
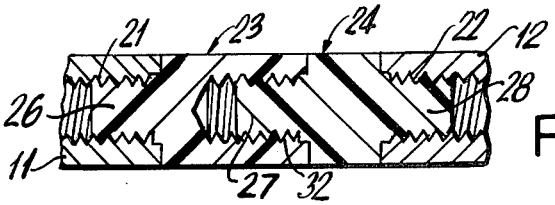
FIG. 6 illustrates in partial sectional view taken along line 6,6 of FIG. 5.

Referring to FIGS. 4, 5 and 6, a second embodiment of the invention is there shown. In this embodiment, elements which are identical with those shown in the first embodiment have the same numerical designation. The essential difference in this embodiment is the provision of a central portion which has two sub-portions 23 and 24. Each sub-portion is composed of solid plastic. One of the sub-portions 23 has a body 25, a threaded projection 26 and an internally threaded portion 32. The other sub-portion 24 includes a body 33 and also two threaded projections 27 and 28, much like the entire central portion 13 in FIGS. 1, 2 and 3. The two sub-portions cooperate by having one of the projections of sub-portion 24, in this case projection 27, removably insertable in internal threaded portion 32 of the sub-portion 23.

Both sub-portions include annular shoulders, in this case indicated as shoulders 29, 36, 30 and 31. As seen in FIG. 6, these various shoulders interlock when the elements are screwed together to provide a stable assembly similar to that of the first embodiment.

In this second embodiment, if it is desired that only the screw arrangement of the plastic portion should open when the assembly is screwed apart, then a some form of glue or cement can be applied to the threads of projections 28 and 26 upon insertion in the end portions. This will lock these assemblies so that only the screw coupling formed by projection 27 and internal threaded portion 32 will come apart when the elements are separated.

While the foregoing description and drawings represent the preferred embodiment of the present invention, it will be obvious to those skilled in the art that various changes and modifications may be made therein without departing from the true spirit and scope of the present invention.

What is claimed is:

1. A separable holder comprising:

a plastic central portion having a body portion and having first and second threaded projections extending from opposite ends of said body portion, said body portion also having annular shoulders at opposite ends thereof;

first and second end portions, each having an internally threaded longitudinal opening and an annular end wall surrounding said opening, said first and second threaded projections for being removably screwed into said corresponding internally threaded openings of said first and second end portions, said annular shoulders of said body abutting corresponding annular end walls of said first and second end portions, each of said first and second end portions having transverse holes therethrough; and first and second split ring elements inserted in said corresponding transverse holes of said first and second end portions, said ring elements for having hole-bearing elements inserted thereon.

2. The separable holder of claim 1, wherein said central portion is made of a transparent plastic.

3. The separable holder of claim 1, wherein said central portion is itself composed of first and second sub-portions, said first sub-portion having said first threaded projection extending from one end and an internally threaded longitudinal opening at the other end, said second sub-portion having said second threaded projection extending from one end and a third threaded projection extending from the other end, said third threaded projection being screwed into said internally threaded portion to form said central portion.

4. The separable holder of claim 3, wherein said first and second projections are cemented into said end portions.

5. The separable holder of claim 3, wherein said second sub-portion has an annular shoulder surrounding said third projection, and said first sub-portion has an annular shoulder surrounding said internally threaded longitudinal opening, said sub-portion shoulders abutting each other when assembled.

6. The separable holder of claim 1, wherein the body portion is tubular.

7. The separable holder of claim 1, wherein the end portions are metallic.

* * * * *